US007272866B1

(12) United States Patent
Bradcovich

(10) Patent No.: US 7,272,866 B1
(45) Date of Patent: Sep. 25, 2007

(54) ATTACHMENT MECHANISM FOR MEDICAL PATIENT PLATFORM

(76) Inventor: James M. Bradcovich, 2275 Hampton Ledges Dr., Cuyahoga Falls, OH (US) 44223

( * ) Notice: Subject to any disclaimer, the term of this patent is extended or adjusted under 35 U.S.C. 154(b) by 98 days.

(21) Appl. No.: 10/981,209

(22) Filed: Nov. 4, 2004

Related U.S. Application Data

(63) Continuation-in-part of application No. 10/427,546, filed on May 1, 2003, now abandoned.

(51) Int. Cl.
*A61G 13/10* (2006.01)
*A61G 13/12* (2006.01)

(52) U.S. Cl. ..... 5/601; 5/663; 5/621

(58) Field of Classification Search ..... 5/658, 5/661, 663, 601, 503.1, 507.1, 621, 623, 5/646; 108/64, 65, 90, 27
See application file for complete search history.

(56) References Cited

U.S. PATENT DOCUMENTS 2,115,130 A * 4/1938 Shults et al. ..... 108/27
3,046,072 A * 7/1962 Douglass, Jr. et al. ..... 5/646
4,484,571 A * 11/1984 Velazquez ..... 5/601
4,487,523 A * 12/1984 Monroe ..... 403/385
4,698,837 A * 10/1987 Van Steenburg ..... 378/208
4,898,491 A * 2/1990 Van Steenburg ..... 403/96
5,077,780 A * 12/1991 Lee, Jr. ..... 378/196
5,135,210 A * 8/1992 Michelson ..... 5/658
5,400,772 A * 3/1995 LeVahn et al. ..... 600/230
5,433,222 A * 7/1995 Boomgaarden et al. ..... 128/869
5,613,254 A * 3/1997 Clayman et al. ..... 5/600
5,758,374 A * 6/1998 Ronci ..... 5/507.1
5,940,912 A * 8/1999 Keselman et al. ..... 5/623
6,023,800 A * 2/2000 Stickley ..... 5/621
6,598,275 B1 * 7/2003 Kolody et al. ..... 24/455
6,708,935 B2 3/2004 Smeed
6,912,959 B2 * 7/2005 Kolody et al. ..... 108/28
7,020,917 B1 * 4/2006 Kolody et al. ..... 5/621
2004/0034932 A1 2/2004 Zacharopoulos
2004/0088793 A1 5/2004 Koch
2004/0123389 A1 7/2004 Boucher
2004/0216232 A1 * 11/2004 Bradcovich ..... 5/601

* cited by examiner

*Primary Examiner*—Robert G. Santos
(74) *Attorney, Agent, or Firm*—Hahn Loeser & Parks LLP; Bret A. Hrivnak

(57) ABSTRACT

A medical procedural patient platform includes a peripheral edge that can receive a medical patient platform extension. The medical procedural patient platform peripheral edge includes a generally male connecting portion that can receive a female connecting portion located on the medical patient platform extension. The connection is a slip fit and the two components do not snap together. A bracket is included on the medical patient platform extension that allows the medical patient platform extension to rotate at discrete intervals.

20 Claims, 6 Drawing Sheets

ATTACHMENT MECHANISM FOR MEDICAL PATIENT PLATFORM

1. BACKGROUND OF THE INVENTION

A. Field of Invention

This invention pertains to the art of methods and apparatuses of medical procedure and surgery tables and more specifically to attachments for a medical procedure or surgery patient platform.

B. Description of the Related Art

In the medical field it is known for medical practitioners to utilize tables for various medical procedures. In one application, imaging tables are used to scan the interior of the human body for any number of medical conditions. One such application may include X-raying a patient for diagnosis of a physical or medical condition. It is also known in the medical arts to place a patient on a stationary table and maneuver an imaging device around the patient. Yet, certain examining energy rays, such as X-rays, may be blocked, that is to say absorbed, by the patient platform itself.

In the medical art it is also known to utilize medical equipment or accessories on or about the procedural tables. This may include catheters, surgical equipment, and the like. Such equipment is needed in close proximity to the patient and the region of the body being examined or treated. For example, someone's arm may need to be extended to insert an IV. It would be advantageous to have an extension suited for supporting the person's arm while the IV is being inserted. Alternately, an extension may be useful in checking for shoulder movement during diagnosis while the patient is positioned on the examining table.

Therefore, an apparatus and method for extending accessories of various types is needed for use with medical procedure and surgical patient platforms that can be conveniently and quickly placed into, and removed from, various positions. It is also advantageous to have accessory extensions that do not affect examining energy rays. The subject invention obviates the aforementioned difficulties.

II. SUMMARY OF THE INVENTION

According to one aspect of the present invention, a new and improved medical patient platform is provided that does not appreciably absorb X-rays during an X-ray examining procedure.

Another aspect of the present invention includes a medical patient platform extension member that is selectively infinitely positionable along the peripheral edge of the medical patient platform.

Yet another aspect of the present invention includes an accessory extension that fits onto the medical patient platform using energy ray absorbing materials.

Still another aspect of the present invention includes a medical patient platform that has a connecting portion fashioned about the periphery of the medical patient platform.

Another aspect of the present invention includes a medical patient platform extension member that does not significantly absorb medical examining energy rays during the examination process.

A medical patient platform is provided for varied medical procedures that includes a patient platform portion. The patient platform may be a procedural patient platform or a surgical table top or any patient platform used for medical purposes. The medical patient platform includes a connecting portion formed about the entire periphery of the circumference of the medical patient platform. One or more accessory extension may be interlocked onto the connecting portion of the medical patient platform. An operator may select an appropriate location along the periphery of the medical patient platform and attach the one or more accessory extensions in place. Once in place, the accessory extension does not interfere with medical examining rays, such as X-rays, in that is constructed from materials that do not absorb the medical examining energy rays.

Still other benefits and advantages of the invention will become apparent to those skilled in the art to which it pertains upon a reading and understanding of the following detailed specification.

III. BRIEF DESCRIPTION OF THE DRAWINGS

The invention may take physical; form in certain parts and arrangement of parts, at least one embodiment of which will be described in detail in this specification and illustrated in the accompanying drawings which form a part hereof and wherein:

FIG. 1 is an isometric view of a medical procedure patient platform table with an energy ray imaging device;

FIG. 2*a* is an isometric view of a medical procedure/surgical table top (patient platform) with an extension attached thereto;

FIG. 2*b* is a cross-sectional view of a medical procedure/surgical table top (patient platform) with an extension attached thereto;

IV. DESCRIPTION OF THE INVENTION

Figure 1:
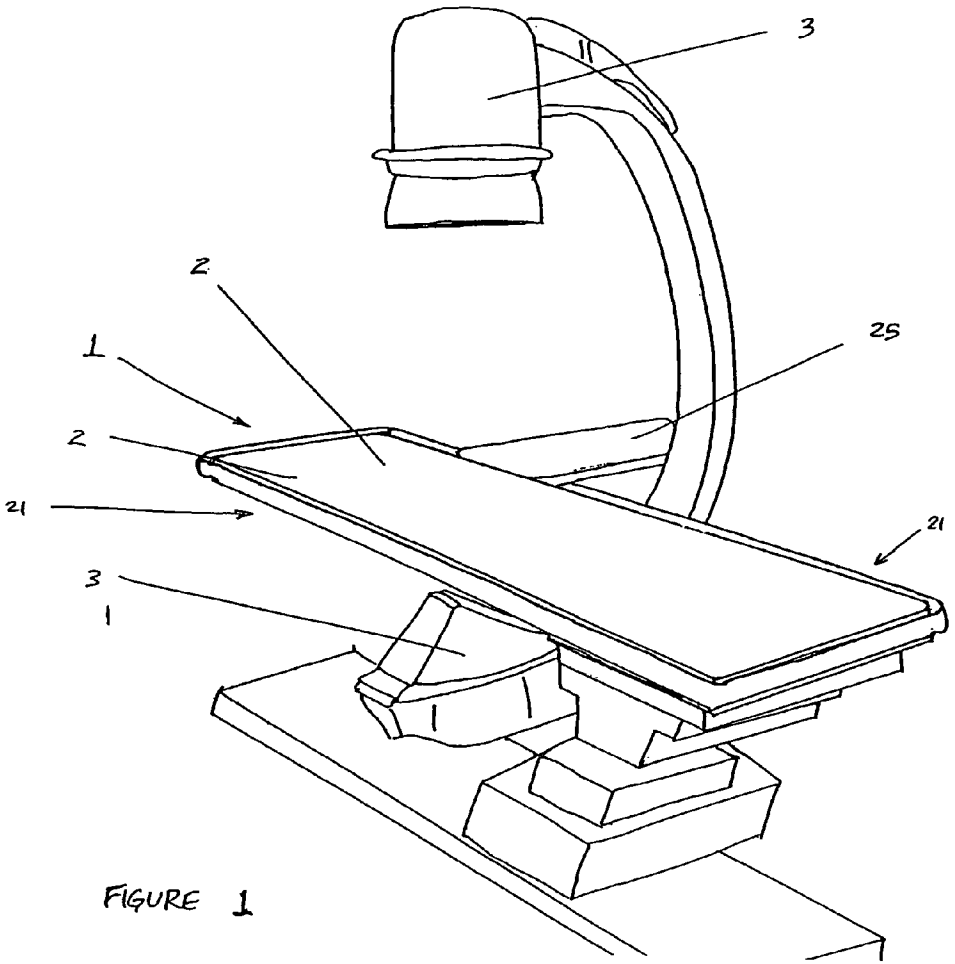

Referring now to the drawings wherein the showings are for purposes of illustrating at least one embodiment of the invention only and not for purposes of limiting the same, FIG. 1 depicts a medical procedure table 1 with patient platform (top) shown generally at 2. The medical procedure patient form table 1 or medical patient table 1 may support a patient, not shown, for use with various medical examining or treatment procedures. It is understood for the subject invention that the medical patient table 1 may be used for any medical purpose including, but not limited to, surgery, minimally invasive surgical procedure, diagnoses of medical conditions, treatment of medical conditions, X-raying, and the like. FIG. 1 depicts one application of the medical patient table 1 used with an energy ray imaging device 3, which may be an X-ray machine 3. The energy ray imaging device 3 may be maneuvered about the medical patient table 1. In this manner, when a patient is placed on the medical patient table 1 the imaging device 3 and/or patient platform 2 may be translated through various axes of movement taking images of the patient at various places and angles without having to move the patient independently of the patient platform 2. Since the medical patient platform 2 may at times reside between the imaging device 3 and the patient, the medical patient platform 2 may be constructed from materials that do not block or absorb the energy examining rays, thus allowing the rays to pass through the patient platform 2 and into the patient. If the medical patient platform 2 absorbed a significant part or all of the energy rays, higher power energy rays may have to be used to obtain a quality image of the patient's body, which may result in damage of the patient's tissue due to the higher energy power level of the rays. That is to say that higher power energy rays would have to be used to overcome the absorption of rays by the patient platform.

Figure 2A:
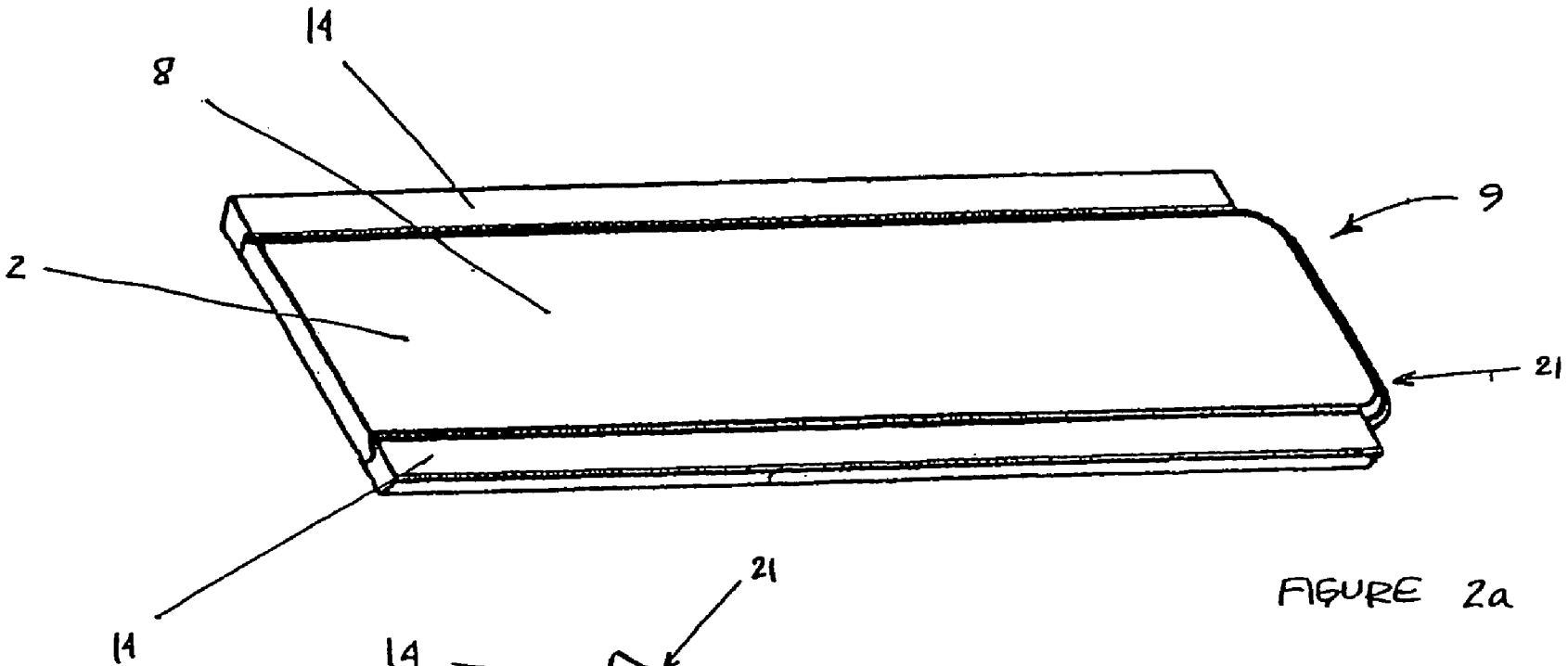
Figure 2B:
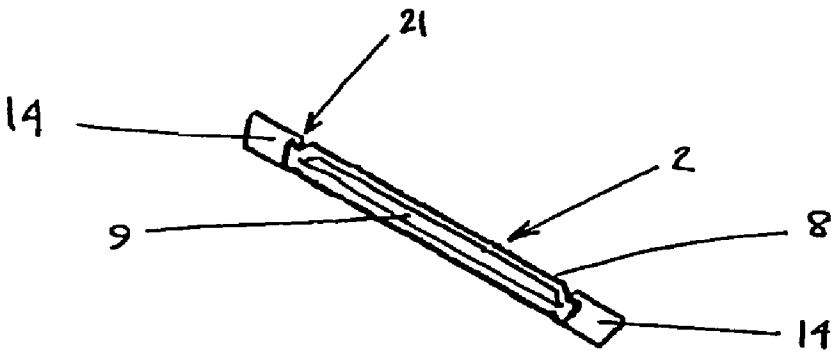

With continued reference to FIG. 1 and now to FIGS. 2*a* and 2*b*, a medical patient platform 2 is depicted apart from the medical patient table 1 in FIGS. 2*a* and 2*b* and separate from a specific medical use. It is noted that the medical patient platform 2 may include extensions, which will be discussed in subsequent paragraphs. The medical patient platform 2 or medical procedure patient platform 2 has a characteristic length L, width W, and thickness T. The dimensions of the length, width, and thickness may be chosen with sound judgment as is appropriate for use in supporting a patient as described above. In one embodiment, the medical patient platform 2 is generally rectangular. However, any geometric configuration of medical patient platform 2 may be chosen with sound engineering and/or medical judgment. The medical patient platform 2 may be constructed from a rigid inner core 9 material and an outer skin 8. The core material 9 may be a limited-energy ray absorbing foam that does not appreciably absorb examining energy rays, which may be X-rays, gamma rays, and the like. The outer skin 8 may be constructed from carbon fiber. It is noted that any material may be chosen for the core material 9 and the outer skin 8 that does not substantially affect the examining energy rays.

Figure 3:
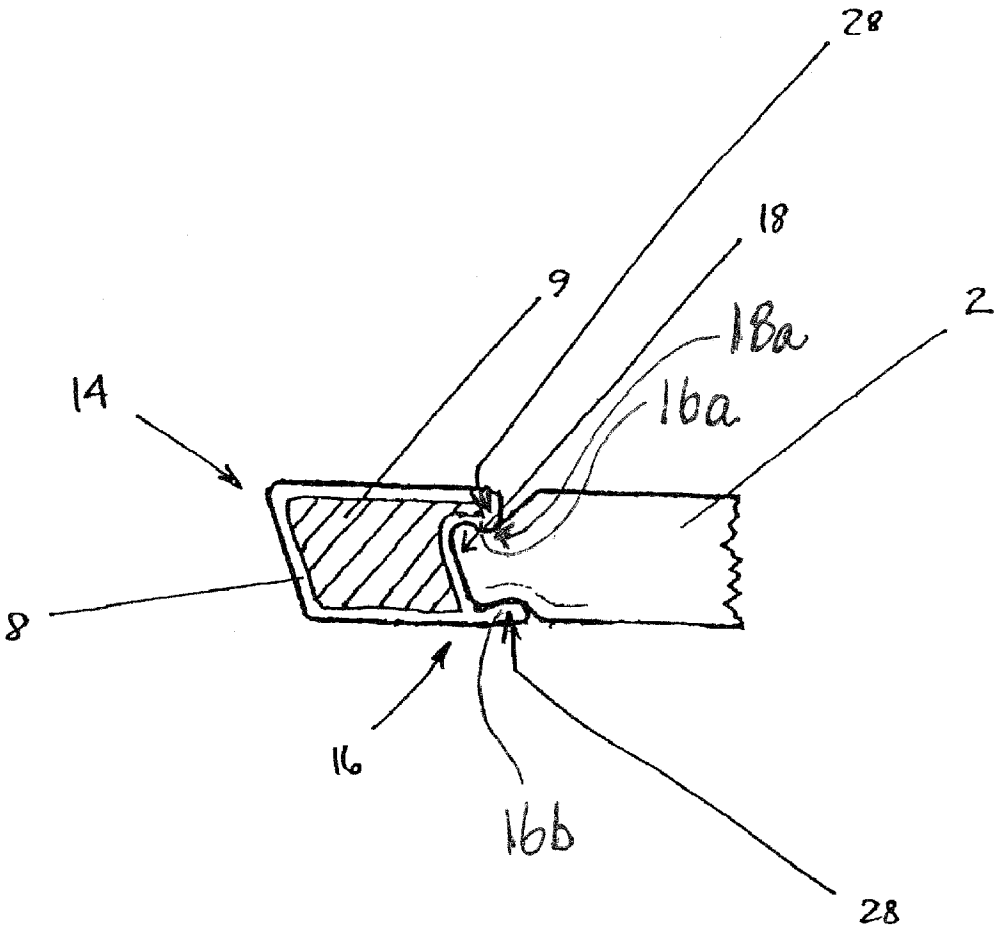
FIG. 3 is a close up cross-sectional view of the extension interlocked to the medical procedure/surgical table top (patient platform)

With continued reference to FIGS. 2*a* and 2*b* and now to FIG. 3, a medical patient platform extension 14 (which, in this application will be interchangeably used with accessory extension 14) is shown attached to the medical patient platform 2. The medical patient platform extension 14 may be selectively attached to the medical patient platform 2 without the use of fasteners such as clamps, screws, and the like. The medical patient platform extension 14 may include a recess 16. Correspondingly, the patient platform 2 may include a protrusion 18 for use in interlocking with the recess 16 of the accessory extension 14. In this way, the recess 16 (which is the female receiving portion) interlocks with the connecting portion 18 (which is the male portion) of the medical patient platform 2. The manner in which the accessory extension 14 interlocks with the medical patient platform 2 will be discussed later in a subsequent paragraph. The medical patient platform 2 may include a peripheral edge 21 traversing the circumference of the length and width of the medical patient platform 2. The male connecting portion 18 may be contiguously fashioned about the entire peripheral edge 21 of the medical patient platform 2. In this manner, the recess 16 may selectively receive the male connecting portion 18 at any point along the peripheral edge 21. This makes the accessory extension 14 versatile and easily positionable at any place conducive to the medical practitioner's job in performing their diagnosis or treatment. In one embodiment, the accessory extension 14 is a patient platform extension, shown in FIG. 2*a*, which increases the width of the patient platform 2. One or both sides of the medical patient platform 2 may be extended as desired for accommodating different size patients and patients having different medical needs. In another embodiment, the accessory extension 14 may include an arm extension 25 that connects to the connecting portion 18 taking up less width along the peripheral edge 21, shown in FIG. 1. It can be clearly seen that the any accessory extension 14 can be constructed according to varied medical needs for interlocking onto the medical patient platform 2, as long as chosen with sound engineering and medical judgment. In this manner, the accessory extension 14 may be selectively infinitely positionable along the entire peripheral edge 21 of the medical patient platform 2.

With reference to FIG. 3, the composition of the accessory extension 14 will now be discussed. The accessory extension 14 may include a core material 9 surrounded by an outer skin 8. The core material 9 may be foam that forms a rigid base of the accessory extension 14. However, any material may be used to form the rigid base of the accessory extension 14 as long as chosen with sound engineering judgment and that does not appreciably absorb examining energy rays. The outer skin 8 may be constructed of carbon fiber forming a laminate layer over the rigid base material. However, any material may be chosen for use as an outer skin material, and any means of affixing the two sections together may be chosen using sound engineering judgment. In this way, the accessory extension 14 may be selectively positioned anywhere about the peripheral edge 21 of the medical patient platform 2 without interfering with examining energy rays during the medical procedure, treatment, or diagnosis.

The recess 16 of the accessory extension 14 and the connecting portion 18 of the medical patient platform 2 may be configured such that the two portions 16, 18 fit together by tilting the medical patient platform extension 14 upward, placing the recess 16 onto the male connecting portion 18 and lowering the medical patient platform extension 14 to a substantially horizontal position. It is noted that the bottom portion 16*b* of the recess 16 is generally flat (slightly arced) such that there is no interference or force required to fit the medical patient platform extension 14 onto the medical patient platform 2. Recess 16 also includes a ridge 16*a* that contributes to the interlocking of recess 16 with connecting portion 18, as ridge 16*a* matingly fits within recess (depression or groove) 18*a* of the connecting portion. In this manner, the medical patient platform extension 14 may easily be installed and removed, as desired.

With references to all of the FIGURES, operation of the invention will now be discussed. An associated operator may grasp the appropriate accessory extension 14 needed for a specific application prior to and/or during a medical procedure. The operator may select where it is best desired to position the accessory extension 14 along the peripheral edge 21 of the medical patient platform 2. The operator may then angle (rotate) the accessory extension 14 upward to fit the recess 16 over the connecting portion 18 of the medical patient platform 2. The operator may then tilt (rotate) the medical patient platform extension 14 downward when the top portion of the recess 16 is juxtaposed to the recess (depression or groove) 18*a* of the connecting portion 18. For disassembly, the operator may simply lift up on the accessory extension 14 and remove the accessory extension 14.

Figure 4:
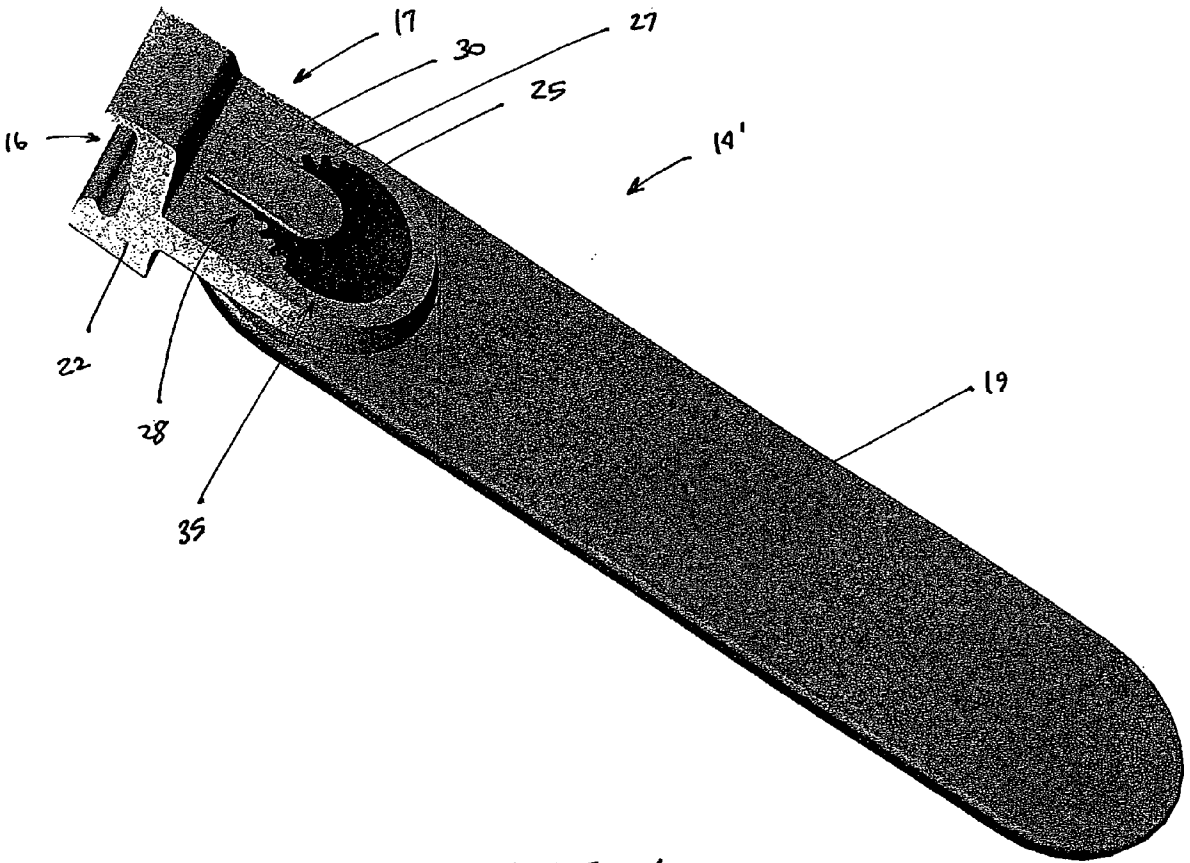
FIG. 4 is a perspective view of the extension interlock for the medical procedure/surgical table top (patient platform)
Figure 5:
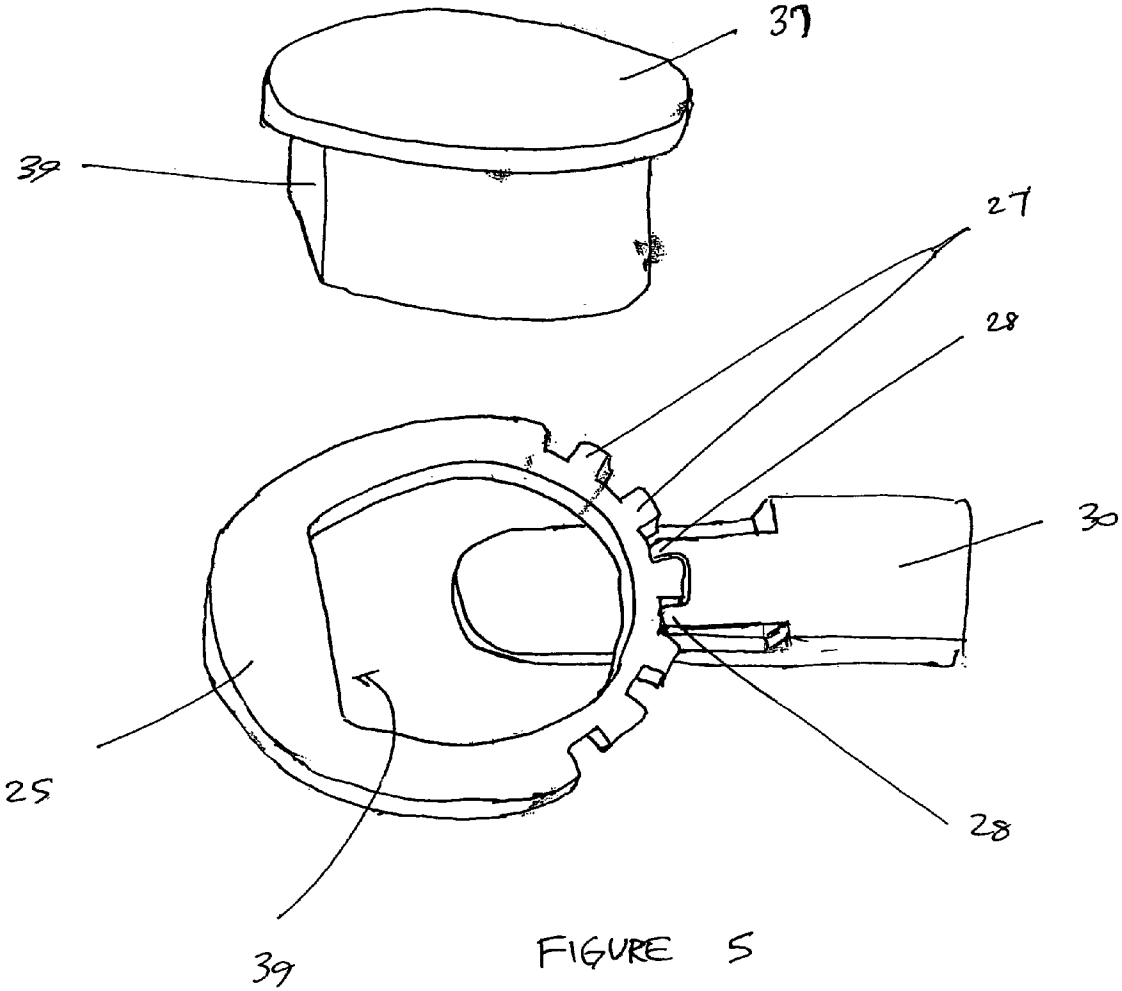
FIG. 5 is a perspective view of the bracket assembly for the extension; and, FIG. 6 is a perspective view of the extension with receiving edge.

With reference now to FIGS. 4 and 5, an alternate embodiment will now be discussed. FIG. 4 shows the underside of a patient platform extension 14. In this example, the patient platform extension 14 may be a patient platform arm extension member 14'. In accordance with the previous discussion, the patient platform arm extension 14' may include the recess 16 for use in fitting onto the male connecting portion 18 on the medical patient platform 2. The recess 16 may be a part of a bracket assembly 17 that is connected to an armrest member 19. It is noted that the arm rest member 19 may be any kind of patient platform extension member. In this manner, the bracket 17 and the arm rest member 19 may comprise the patient platform arm extension member 14'. The bracket assembly 17 may be continuously formed member constructed of material that does not block or absorb the energy examining rays, thus allowing the rays to pass through the bracket assembly and into the body. Similarly, the arm rest member 19 may also be constructed from this kind of material. The bracket assembly 17 may include several different parts that may allow the arm rest member 19 to pivot with respect to the bracket assembly 17. In this way, the entire patient platform arm extension member 14' may be infinitely positionable along the periphery 21 of the medical patient platform 2 and the arm rest member 19 may pivot with respect to the bracket 17. The arm rest member 19 may be replaced by any medical extension device or appliance chosen with sound engineering judgment.

With continued reference to FIGS. 4 and 5, the bracket assembly 17 may include bracket assembly members that make up the bracket assembly 17 and allow the arm rest 19 to pivot with respect to the bracket assembly 17. In one embodiment, the bracket assembly 17 may include a bracket frame 22, a gear member 25, and an index member 30. It is noted that the bracket frame 22 may include the recess 16 as discussed above. The bracket frame 22 may be a contiguously formed bracket frame 22. However, any manner of constructed bracket frame 22 may be chosen with sound medical and engineering judgment. In this embodiment, the gear member 25 may include gear teeth 27, fashioned at least part way around the periphery of the gear member 25, as shown in FIG. 5. The bracket frame 22 may rotatably receive the gear member 25 within an aperture 35 formed in the bracket frame 22. In this manner, the aperture 35 and the gear member 25 may be substantially circular in configuration. Thus, the gear member 25 may rotate within the bracket frame 22. It is noted that any configuration of aperture 35 and gear member 25 and any manner of rotatably receiving the gear member 25 within the bracket frame 22 may be chosen with sound engineering judgment. The arm rest 19, or other medical implement, may be fixedly attached to the gear member 25 so as to cause the arm rest 19 to move in conjunction with the gear member 25. In one embodiment, a wedge member 37 may be included that passes from one side of the arm rest 19, through the arm rest 19, and into the bracket frame 22. A flat 39 on the wedge member 37 may be received into the gear member 25, which may also have a matching flat 39'. In this manner, the arm rest 19 and wedge member 37 may be fixed in placed with respect to the gear member 25 such that when the gear member 25 is rotated, the arm rest 19 is rotated in unison.

With continued reference to FIGS. 4 and 5, the index member 30 may be connected to the bracket frame 22. Additionally, the index member 30 may be adjustable between an engaged and disengaged position as will be discussed presently. In the present embodiment, the index member 30 may include one or more gear teeth 28 that may engage the gear teeth of the gear member 25. This is necessary to discretely index the arm rest 19 about a certain radius. When the index member 30 is in the engaged position, the gear teeth 28 of the index member 30 mate with the gear teeth 27 of the gear member 25, thereby preventing the gear member 25 from rotating. Alternately, when the index member 30 is in the disengaged position, gear teeth 28 are disengaged from gear teeth 27, thereby allowing the gear member 25 and arm rest 19 to rotate. In this manner, an operator may move the index member 30 into the disengaged position, rotate the arm rest 19 as desired and move the index member 30 back into the engaged position, which will hold the gear member 25, and correspondingly the arm rest 19, in position. It is noted that the angle through which the arm rest 19 may rotate is dependent upon the number of gear teeth 28 fashioned on the periphery of the gear member 25. Any manner of connecting the index member 30, gear member 25, wedge member 37, and arm rest 19 may be chosen with sound engineering judgment.

Figure 6:
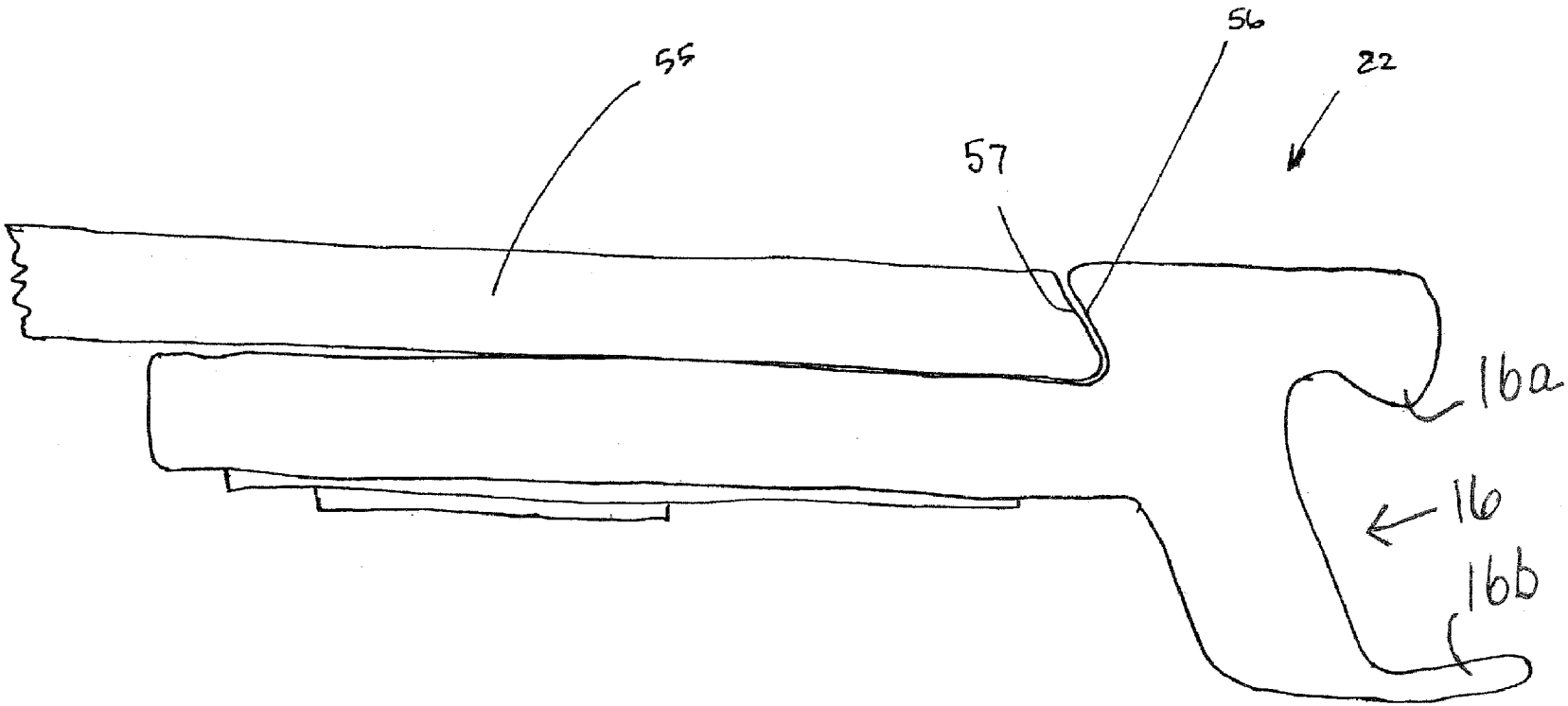

With reference to FIGS. 4 and 5 and now to FIG. 6, the bracket member 22 may include a bracket extension member 55 that may be received by the bracket member 22. The bracket member 22 may be fashioned to include an angled ledge 56, as shown in the FIG. 6, to prevent upward movement of the bracket extension member 55 when the bracket extension member 55 is juxtaposed to the bracket member 22. In this manner, the bracket extension member 55 is held in place during use. It is noted that any angle of ledge 56 may be chosen with sound engineering judgment as is appropriate for use with the present invention. The bracket extension member 55 may similarly have an angled surface 57 to match the angle of the ledge 56. In one embodiment, the ledge 56 is linear sloped surface. However, it is contemplated in an alternate embodiment that the ledge may be curved in either a convex or a concave shape. Still, any configuration of ledge 56 may be chosen with sound engineering judgment.

At least one embodiment has been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

I claim:

1. A medical device comprising:

a medical procedure patient platform having a peripheral edge, at least a length of the peripheral edge having a connecting portion; and, at least a first extension having a substantially rigid connecting portion interlocking member comprising a recess, a ridge forming a boundary of the recess, and an extension also forming another boundary of the recess to facilitate attachment of the connecting portion to the interlocking member, the ridge being in a substantially fixed relation to the extension, the connecting portion including a recess-mating protrusion and a ridge-mating groove.

2. The medical device of claim 1, wherein the at least a first extension does not substantially absorb associated examining energy rays.

3. The medical device of claim 2, wherein the at least a first extension is comprised of:

a rigid core; and, a skin portion, wherein the skin portion is constructed of carbon fiber.

4. The medical device of claim 3, wherein the medical procedure patient platform does not substantially absorb associated examining energy rays.

5. The medical device of claim 1, wherein the at least a first extension is selectively infinitely positionable along the at least a length of the peripheral edge.

6. The medical device of claim 5, wherein the at least a first extension is an arm extension.

7. The medical device of claim 5, wherein the at least a first extension is a catheter support extension.

8. The device of claim 1, wherein the at least a first extension is a platform extension or an accessory extension.

9. The device of claim 1, wherein the interlocking member does not substantially absorb associated examining energy rays.

10. The device of claim 9, wherein the interlocking member is comprised of:

a rigid core; and, a skin portion, wherein the skin portion is constructed of carbon fiber.

11. The medical device of claim 1, the extension being slightly arced.

12. A method for extending a medical procedure patient platform, comprising the steps of:

providing a medical procedure patient platform having a peripheral edge, at least a length of the peripheral edge having a connecting portion;

providing at least a first extension having a substantially rigid connecting portion interlocking member, wherein the interlocking member is adapted to interlock with the connecting portion;

placing a portion of the interlocking member in contact with a portion of the connecting portion, wherein the interlocking member includes a recess, a ridge forming a boundary of the recess, and an extension also forming another boundary of the recess to facilitate attachment of the connecting portion to the interlocking member, and the connecting portion includes a recess-mating protrusion and a ridge-mating groove; and, rotating substantially the entire at least first extension downward, thereby interlocking the interlocking member with the connecting portion.

13. The method of claim 12, wherein the step of providing at least a first extension having a substantially rigid connecting portion interlocking member, wherein the interlocking member is adapted to interlock with the connecting portion, further comprises the step of:

providing at least a first extension that does not substantially absorb examining energy rays, the at least a first extension having a substantially rigid connecting portion interlocking member, wherein the interlocking member is adapted to interlock with the connecting portion.

14. The method of claim 12, wherein the step of providing at least a first extension having a substantially rigid connecting portion interlocking member, wherein the interlocking member is adapted to interlock with the connecting portion, further comprises the step of:

providing at least a first extension having a substantially rigid connecting portion interlocking member that is infinitely positionable along the at least a length of the peripheral edge, wherein the interlocking member is adapted to interlock with the connecting portion; and, wherein before the step of placing a portion of the interlocking member in contact with a portion of the connecting portion there further comprises the step of:

selecting an infinitely positionable location for placing the interlocking member onto the connecting portion.

15. The method of claim 12, wherein the ridge being in a substantially fixed relation to the extension.

16. The method of claim 12, the extension being slightly arced.

17. A medical device comprising:

a medical procedure patient platform having a peripheral edge, at least a length of the peripheral edge having a connecting portion;

at least a first extension having a substantially rigid connecting portion interlocking member comprising a recess and a ridge, the interlocking member being adapted to rotatably interlock with the connecting portion, the at least a first extension including a bracket member and an extension implement discretely rotatably connected with respect to the bracket member, and at least a portion of the bracket member comprising the interlocking member;

a gear member and an indexing member, each being operably connected to one of the first extension and the extension implement, and the indexing member being selectively moveable between first and second positions, where the implement is selectively rotatable when the indexing member is in the first position and the implement is prevented from rotating when the indexing member is in the second position, wherein the gear member and at least a portion of the indexing member substantially adjacent to the gear member do not substantially absorb associated examining energy rays.

18. The medical device of claim 17, wherein the at least a first extension and the extension implement do not substantially absorb associated examining energy rays.

19. The medical device of claim 17, the ridge being in a substantially fixed relation to the extension.

20. The medical device of claim 17, the ridge forming a boundary of the recess.

* * * * *

UNITED STATES PATENT AND TRADEMARK OFFICE

CERTIFICATE OF CORRECTION

PATENT NO. : 7,272,866 B1
APPLICATION NO. : 10/981209
DATED : September 25, 2007
INVENTOR(S) : James M. Bradcovich It is certified that error appears in the above-identified patent and that said Letters Patent is hereby corrected as shown below:

In Column 8, line 9
replace "The method of claim 12, wherein the ridge being in a" with
--The method of claim 12, the ridge being in a--

Signed and Sealed this

Sixth Day of May, 2008

JON W. DUDAS
*Director of the United States Patent and Trademark Office*